US007410249B2

(12) United States Patent
Inoue

(10) Patent No.: US 7,410,249 B2
(45) Date of Patent: Aug. 12, 2008

(54) IMAGE FORMING APPARATUS

(75) Inventor: Hiroshi Inoue, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 302 days.

(21) Appl. No.: 11/235,175

(22) Filed: Sep. 27, 2005

(65) Prior Publication Data

US 2006/0066697 A1 Mar. 30, 2006

(30) Foreign Application Priority Data

Sep. 28, 2004 (JP) ..... 2004-282645

(51) Int. Cl.
*B41J 2/18* (2006.01)
*B41J 2/165* (2006.01)

(52) U.S. Cl. ..... 347/89; 347/30

(58) Field of Classification Search ..... 347/20, 347/29, 30, 31, 36, 89, 90
See application file for complete search history.

(56) References Cited

U.S. PATENT DOCUMENTS 4,700,202 A * 10/1987 Kuranishi et al. ..... 347/86
5,561,448 A * 10/1996 Kaneko et al. ..... 347/29
5,592,200 A * 1/1997 Kaneko ..... 347/30
6,283,585 B1 * 9/2001 Ikkatai et al. ..... 347/85
6,540,322 B2 * 4/2003 Usui et al. ..... 347/29
6,793,317 B2 * 9/2004 Shima ..... 347/29
7,222,935 B2 * 5/2007 Ono ..... 347/36

FOREIGN PATENT DOCUMENTS

JP 2003-266745 A 9/2003

* cited by examiner

*Primary Examiner*—Anh T. N. Vo
(74) *Attorney, Agent, or Firm*—Birch, Stewart, Kolasch & Birch, LLP

(57) ABSTRACT

The image forming apparatus comprises: an ejection head which includes a plurality of nozzles to eject a liquid to deposit the liquid on a recording medium being conveyed relatively to the ejection head to form an image on the recording medium; a tank which stores the liquid to be supplied to the nozzles and has an adjustable internal pressure; a liquid supply path which connects the tank and the ejection head; a cap which faces a nozzle face on which the nozzles of the ejection head are formed; a liquid collection path which is capable of connecting the cap and the tank; and a liquid circulating device which is provided on the liquid collection path, collects the liquid in the ejection head through the cap, circulates the liquid to the tank along the liquid collection path, and adjusts the internal pressure of the tank to a desired value.

10 Claims, 14 Drawing Sheets

IMAGE FORMING APPARATUS

BACKGROUND OF THE INVENTION

1. Field of the Invention

The present invention relates to an image forming apparatus, and more particularly to an image forming apparatus which forms images by depositing a liquid such as ink onto a recording medium from an ejection head.

2. Description of the Related Art

An inkjet recording apparatus (inkjet printer) having an ink ejection head (print head) in which a large number of nozzles are arranged is known as a conventional image forming apparatus. This inkjet recording apparatus forms an image on a recording medium by ejecting ink in the form of liquid droplets from the nozzles of the ink ejection head onto the recording medium while moving the ink ejection head relatively to the recording medium.

Various conventional methods are known for ejecting the ink in this type of inkjet recording apparatus. Known examples of ink ejection methods include a piezoelectric method, in which a diaphragm constituting a part of a pressure chamber (ink chamber) is deformed by the deformation of a piezoelectric element (piezoelectric ceramic), thereby altering the volume of the pressure chamber such that when the pressure chamber volume increases, ink is introduced into the pressure chamber through an ink supply passage, and when the pressure chamber volume decreases, the ink inside the pressure chamber is ejected through the nozzles as an ink droplet, and a thermal inkjet method in which air bubbles are formed by heating the ink, and the ink is ejected by the expansion energy generated as the air bubbles grow.

In an image forming apparatus having an ink ejection head, such as an inkjet recording apparatus, ink is supplied to the ink ejection head from an ink tank which stores the ink via an ink supply passage, and the ink is ejected using one of the various ejection methods described above. When the ink used in such an image forming apparatus is deposited on the recording medium, it is desirable that the ink dry and become fixed immediately.

The nozzles of the ink ejection head are filled with ink at all times so that when a printing command is issued, printing can be executed immediately, but if the ink in the nozzles dries, ink ejection from the nozzles becomes unstable, and hence during standby periods when printing is not performed, the ink ejection head is sealed tightly by a cap to prevent the ink in the nozzles from drying.

However, during printing the ink in the nozzles is exposed to the air, and hence the ink in a nozzle from which ejection is not performed for a long time dries, leading to an increase in the viscosity (thickening) of the ink. As a result, the nozzle may become blocked, the ink in the nozzle may disappear, and hence ejection may become impossible.

Further, when bubbles that have become mixed into the ink supply passage and so on accumulate in front of a foreign matter removal filter disposed in the ink ejection head or ink supply passage, the accumulated bubbles may block the ink supply so that the ink cannot be ejected from the nozzles.

Conventionally, a purging (spitting) operation is performed at fixed time intervals to remove the viscous ink or ink containing foreign matter or bubbles that is the cause of the defective ejection and thereby restore the ink ejection head. In this purging operation, the cap is placed over the ink ejection head, and the ink is ejected forcibly from the nozzles toward the cap. Alternatively, a suction operation is performed periodically by placing the cap over the ink ejection head and suctioning the ink out of the nozzles using a pump.

If the purged or suctioned ink is discarded at this time, this constitutes wasteful ink consumption, and therefore, to limit the amount of wasted ink as much as possible, ink circulation is performed to return the suctioned ink to the ink tank (sub-tank) so that the ink can be re-supplied to the ink ejection head and reused.

For example, a device is known in which a head is sealed tightly with a cap, and a pump is driven to suction ink from the head into the cap. The ink suctioned into the cap is then led through a pipe to the sub-tank side, and returned to the sub-tank through a filter. Thus the waste ink is circulated and reused (see Japanese Patent Application Publication No. 2003-266745, for example).

However, in the conventional inkjet printer having an ink circulation path described in Japanese Patent Application Publication No. 2003-266745, the ink circulation path for returning the ink suctioned into the cap to the sub-tank is wound around the outside of the head, and therefore the ink circulation path is long and complicated, disposal space must be secured for the ink circulation path, and there is a high likelihood of bubbles merging with the ink through the circulation path, which is constituted by a tube or the like.

Furthermore, in the prior art the pump which circulates the ink and a pump which adjusts the internal pressure of the sub-tank are provided separately rather than being constituted by a single pump, making the apparatus constitution complicated and preventing size reductions.

SUMMARY OF THE INVENTION

The present invention has been contrived in consideration of these circumstances, and it is an object thereof to provide an image forming apparatus in which a circulation system for returning a suctioned liquid to a sub-tank can be simplified, enabling space-saving.

In order to attain the aforementioned object, the present invention is directed to an image forming apparatus, comprising: an ejection head which includes a plurality of nozzles to eject a liquid to deposit the liquid on a recording medium being conveyed relatively to the ejection head to form an image on the recording medium; a tank which stores the liquid to be supplied to the nozzles and has an adjustable internal pressure; a liquid supply path which connects the tank and the ejection head; a cap which faces a nozzle face on which the nozzles of the ejection head are formed; a liquid collection path which is capable of connecting the cap and the tank; and a liquid circulating device which is provided on the liquid collection path, collects the liquid in the ejection head through the cap, circulates the liquid to the tank along the liquid collection path, and adjusts the internal pressure of the tank to a desired value.

According to the present invention, the liquid circulation device also serves as the internal pressure adjusting device, enabling a simplification of the liquid circulation system, space-saving, and a reduction in cost.

Preferably, the liquid collection path is provided so as to partly pass through the ejection head, thereby connecting the cap and the tank when the cap is attached tightly to a surface of the ejection head in which an ink collection aperture is provided.

According to the present invention, at least a part of the liquid collection path is disposed within the ejection head, and therefore the path along which the liquid is circulated can be shortened, and the length of the tube, through which gases pass easily, can be minimized, thereby minimizing the danger of air bubbles becoming mixed into the liquid.

Preferably, the nozzles and the ink collection aperture are provided on a substantially same plane.

By providing a liquid collection opening on the same plane as the nozzle face, the cap seal for performing suction on the nozzle and the seal for collecting the ink can be formed easily. Moreover, nozzle cleaning through suction can be performed, and therefore an improvement in reliability can be achieved.

Preferably, a part of the cap corresponding to an opening portion of the liquid collection path provided in the nozzle face when the cap is attached tightly to the nozzle face of the ejection head comprises a liquid holding structure which moves the liquid in the cap toward the opening portion.

Preferably, the liquid holding structure is formed from at least one of a porous member and a rib-form member.

According to the present invention, the liquid within the cap can be suctioned using little force, and hence the size of the pump can be reduced.

Preferably, the image forming apparatus further comprises: a drain which discharges the liquid to a bottom face of the cap and is provided on an upstream side of the liquid holding structure in a flow direction of the liquid that is collected in the cap, wherein the liquid holding structure also has a filter function.

Alternatively, it is also preferable that the image forming apparatus further comprises: a drain which discharges the liquid to a bottom face of the cap and is provided on an upstream side of the liquid holding structure in a flow direction of the liquid that is collected in the cap, wherein the cap comprises a filter between the liquid holding structure and a reception side for the liquid that is collected in the cap.

By providing the liquid support structure with a filter function or providing a filter separately to the liquid support structure, and by providing the drain through which the liquid is discharged, foreign matter is prevented from entering the circulating liquid, and highly viscous liquid that cannot be reused can be discharged through the drain.

Preferably, the filter is disposed in a higher position than the bottom face of the cap in which the drain is formed.

According to the present invention, the foreign matter that accumulates within the liquid can be discharged easily.

Preferably, the bottom face of the cap which receives the liquid collected in the cap is inclined so that a part in which the drain is formed forms a lowest part of the cap.

According to the present invention, the liquid that is suctioned into the cap can be circulated smoothly.

According to the image forming apparatus of the present invention, as described above, the liquid circulating device which circulates the liquid from the cap to the tank also serves as the tank internal pressure adjusting device, enabling a simplification of the liquid circulation system, space-saving, and a reduction in cost. Moreover, after being circulated, the liquid is reused, and therefore the tank layout freedom can be improved.

Further, when the liquid collection path is provided inside the print head so as to pass through the nozzle face of the print head, the ink collection path does not have to be wound around the print head, as in the prior art, enabling a reduction in the length of the ink collection path. Furthermore, effects on the viscosity, surface stress, and other performance factors of the ink can be reduced to a minimum.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:.

DETAILED DESCRIPTION OF THE PREFERRED EMBODIMENTS

Figure 1:
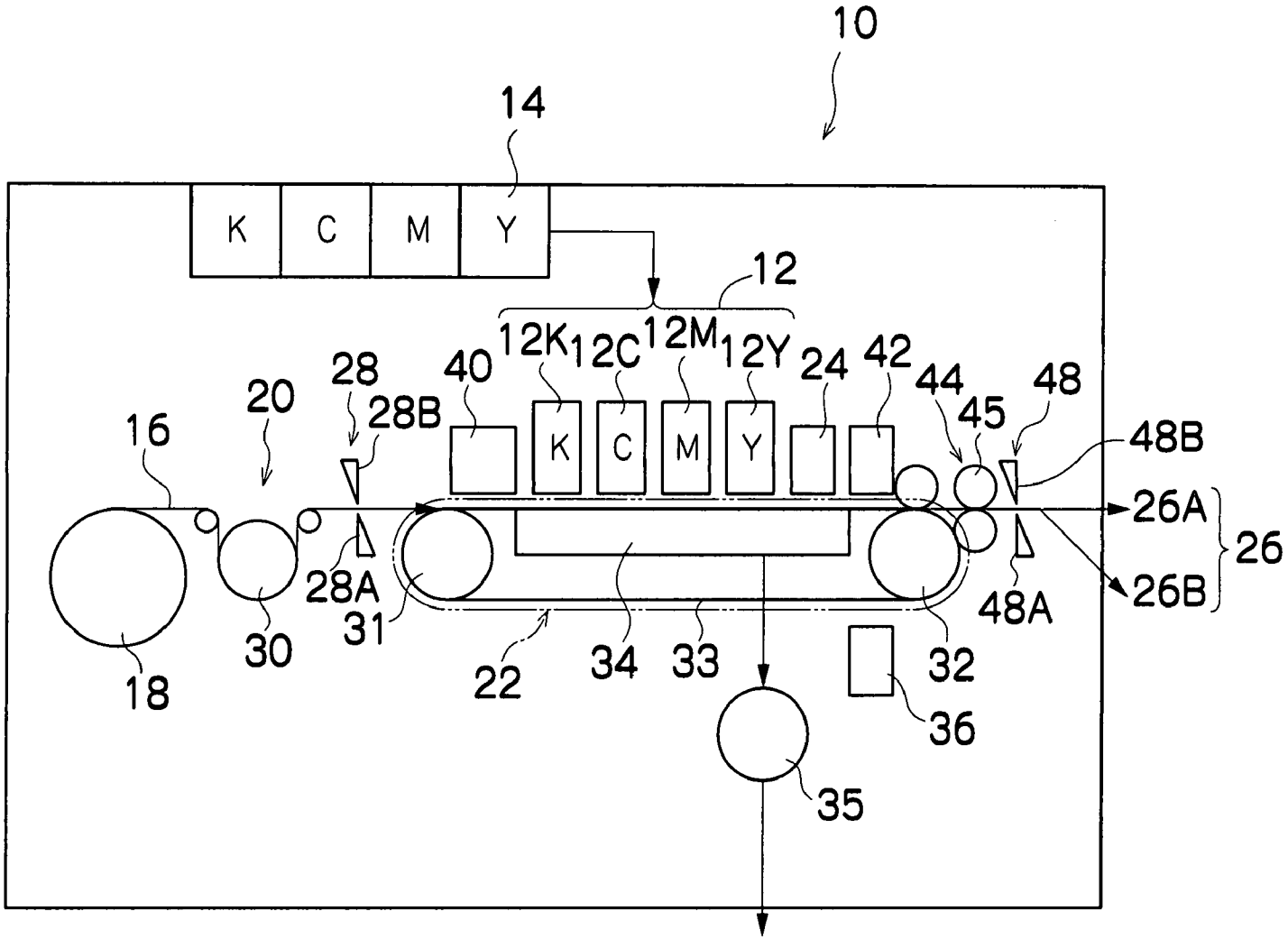
FIG. 1 is a general schematic drawing showing an embodiment of an inkjet recording apparatus serving as an image forming apparatus according to the present invention.

FIG. 1 is a general schematic drawing showing an embodiment of an inkjet recording apparatus serving as an image forming apparatus according to the present invention.

As shown in FIG. 1, an inkjet recording apparatus 10 comprises a print unit having a plurality of print heads (inkjet recording heads) 12K, 12C, 12M, 12Y provided for each ink color, an ink storing and loading unit 14 in which the ink supplied to the print heads 12K, 12C, 12M, 12Y is stored, a paper supply unit 18 which supplies recording paper 16, a decurling unit 20 which removes curls from the recording paper 16, a suction belt conveyance unit 22 disposed opposite a nozzle face (ink ejection face) of the print unit 12 for conveying the recording paper 16 while maintaining the flatness of the recording paper 16, a print determination unit 24 which reads printing results generated by the print unit 12, and a paper output unit 26 which outputs the printed recording paper (printed object) to the outside.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of an apparatus constitution using rolled paper, as shown in FIG. 1, a cutter 28 is provided, and the rolled paper is cut into the desired size by this cutter 28. The cutter 28 is constituted by a stationary blade 28A having a length which is equal to or greater than the width of the conveyance path for the recording paper 16, and a round blade 28B which moves along the stationary blade 28A. The stationary blade 28A is provided on the rear side of the print surface, and the round blade 28B is disposed on the print surface side so as to sandwich the conveyance path together with the stationary blade 28A. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction.

The belt 33 is driven in the clockwise direction in FIG. 1 when the motive force of a motor 88 (not shown in FIG. 1, but shown in FIG. 8) is transmitted to at least one of the rollers 31 and 32 around which the belt 33 is wrapped, and thus the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
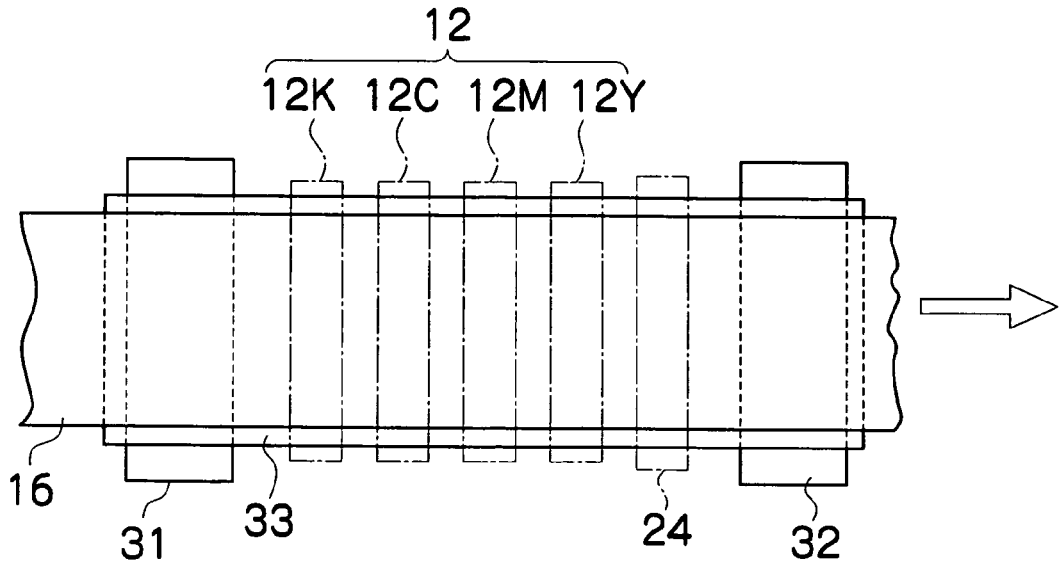
FIG. 2 is a principal plan view of the periphery of a print unit in the inkjet recording apparatus shown in FIG. 1.

The print unit 12 forms a so-called full-line head (see FIG. 2) in which line heads having a length which corresponds to the maximum paper width are disposed in an orthogonal direction (main scanning direction) to the paper conveyance direction (sub-scanning direction). As shown in FIG. 2, each print head 12K, 12C, 12M, 12Y is constituted as a line head in which a plurality of ink ejection ports (nozzles) are arranged over a length which exceeds at least one side of the maximum sized recording paper 16 that can be used in the inkjet recording apparatus 10.

The print heads 12K, 12C, 12M, 12Y corresponding to the respective ink colors are disposed in order of black (K), cyan (C), magenta (M), and yellow (Y) from the upstream side (the left side in FIG. 1) in the conveyance direction (paper conveyance direction) of the recording paper 16. A color image can be formed on the recording paper 16 by depositing colored ink thereon from the respective print heads 12K, 12C, 12M, 12Y while conveying the recording paper 16.

According to the print unit 12, in which a full line head covering the entire paper width is provided for each ink color, an image can be recorded on the entire surface of the recording paper 16 by performing an operation to move the recording paper 16 relatively to the print unit 12 in the paper conveyance direction (sub-scanning direction) a single time (i.e., with one sub-scan). In so doing, it is possible to achieve a higher print speed than that of a shuttle head, in which the print head performs a reciprocating movement in an orthogonal direction (the main scanning direction) to the paper conveyance direction. As a result, an improvement in productivity can be achieved.

Here, the terms "main scanning direction" and "sub-scanning direction" are used with the following meaning. When the nozzles are driven in a full line head having a nozzle array corresponding to the entire width of the recording paper, an operation such as (1) driving all of the nozzles simultaneously, (2) driving the nozzles in sequence from one nozzle to another, or (3) dividing the nozzles into blocks and driving the nozzles in block sequence from one block to another, is performed. Main scanning is defined as performing one of these operations such that one line (a line constituted by a single dot array or a line constituted by a plurality of dot arrays) is printed in the width direction of the paper (the orthogonal direction to the recording paper conveyance direction). The direction of the line (the lengthwise direction of a strip-form area) recorded as a result of the main scan is known as the main scanning direction.

Meanwhile, sub-scanning is defined as printing the line (a line constituted by a single dot array or a line constituted by a plurality of dot arrays) formed by the main scan described above repeatedly by moving the full line head and recording paper relatively to each other as described above. The direction in which this sub-scan is performed is known as the sub-scanning direction. In short, the recording paper conveyance direction is the sub-scanning direction, and the orthogonal direction thereto is the main scanning direction.

Although the configuration with the KCMY four standard colors is described in the present embodiment, combinations of the ink colors and the number of colors are not limited to those. Light inks or dark inks can be added as required. For example, a configuration is possible in which print heads for ejecting light-colored inks such as light cyan and light magenta are added. Furthermore, there are no particular restrictions of the sequence in which the heads of respective colors are arranged.

As shown in FIG. 1, the ink storing and loading unit 14 comprises tanks storing colored ink corresponding to the respective print heads 12K, 12C, 12M, 12Y. Each tank communicates with its print head 12K, 12C, 12M, 12Y via a pipe not shown in the drawing. The ink storing and loading unit 14 further comprises a notification device (a display device, warning sound generating device or the like) for providing notification of a low remaining ink amount, and a mechanism for preventing situations in which the wrong ink color is loaded.

The print determination unit 24 has an image sensor (line sensor) for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern printed by the print heads 12K, 12C, 12M, 12Y of the respective colors, and determines ink ejection from each head. The ejection determinations comprise the presence or absence of ejection, dot size measurement, measurement of the dot landing position, and so on.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the output unit 26A for the target image is provided with a sorter for collecting images according to print orders.

Figure 3:
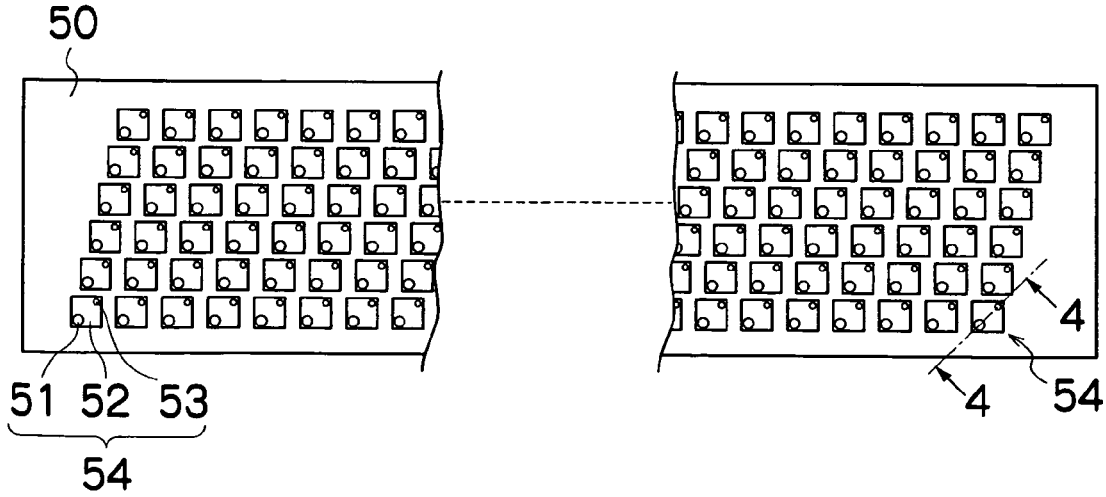
FIG. 3 is a projected plan view showing a structural example of the print head.

Next, the print head (liquid droplet ejection head) will be described. The print heads 12K, 12C, 12M, 12Y provided for the respective ink colors have a common structure, and hence in the following description, the print heads will be denoted with the reference numeral 50. FIG. 3 shows a projected plan view of the print head 50.

As shown in FIG. 3, in the print head 50 of this embodiment, pressure chamber units 54 constituted by a nozzle 51 which ejects ink in the form of liquid droplets, a pressure chamber 52 which applies pressure to the ink during ink ejection, and an ink supply port 53 which supplies ink to the pressure chamber 52 through a common flow passage not shown in the drawing, are arranged in a two-dimensional, staggered matrix form so that the nozzles 51 are provided at a high density.

As shown in FIG. 3, each pressure chamber 52 has a substantially square form when seen from above. The nozzle 51 is formed at one end of the diagonal, and the ink supply port 53 is provided at the other end.

Figure 4:
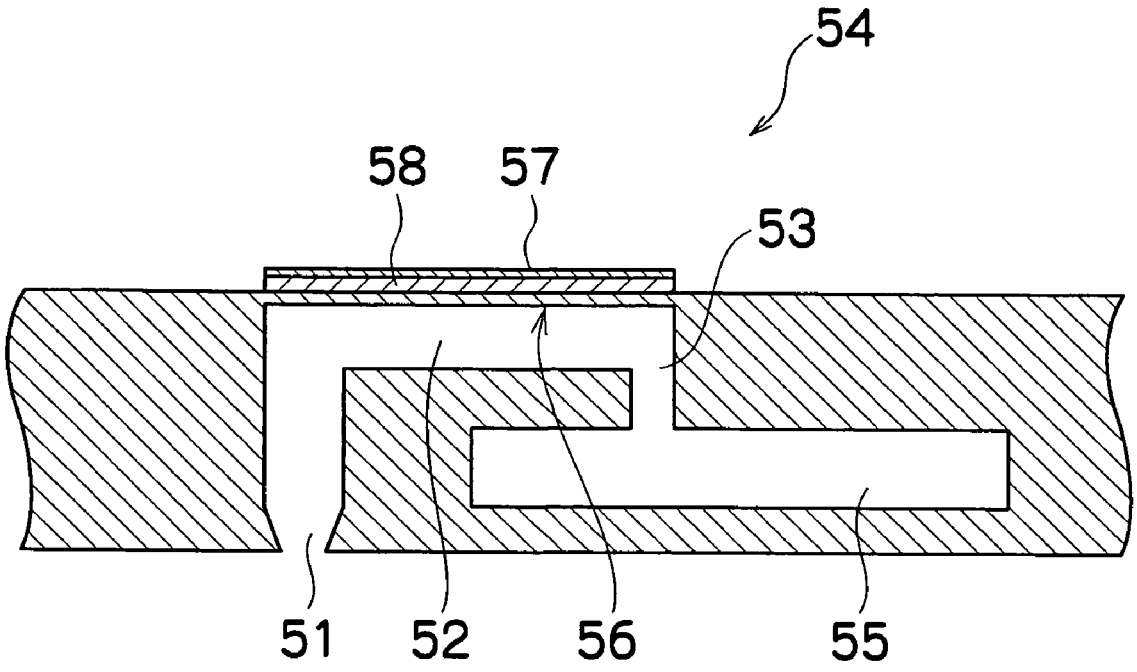
FIG. 4 is a sectional view showing a structural example of a pressure chamber, along a line 4-4 in FIG. 3.

A sectional view along a line 4-4 in FIG. 3 is shown in FIG. 4.

As shown in FIG. 4, the pressure chamber unit 54 is formed by the pressure chamber 52 which communicates with the nozzle 51 for ejecting the ink. A common flow passage 55 for supplying ink to the pressure chamber 52 communicates with the pressure chamber 52 via the supply port 53. One surface of the pressure chamber 52 (the ceiling face in FIG. 3) is constituted by a diaphragm 56, and a piezoelectric element 58 which applies pressure to the diaphragm 56 to cause the diaphragm 56 to deform is joined to the top of the diaphragm 56. An individual electrode 57 is provided on the upper face of the piezoelectric element 58. The diaphragm 56 also serves as a common electrode.

The piezoelectric element 58 is sandwiched by the common electrode (diaphragm 56) and individual electrode 57, and deformed when a drive voltage is applied to these two electrodes 56, 57. The diaphragm 56 is pressed by the deformation of the piezoelectric element 58, causing the volume of the pressure chamber 52 to decrease such that ink is ejected from the nozzle 51. When application of the voltage to the two electrodes 56, 57 is released, the piezoelectric element 58 returns to normal, the pressure chamber 52 returns to its original volume, and new ink is supplied to the pressure chamber 52 from the common flow passage 55 via the supply port 53.

Figure 5:
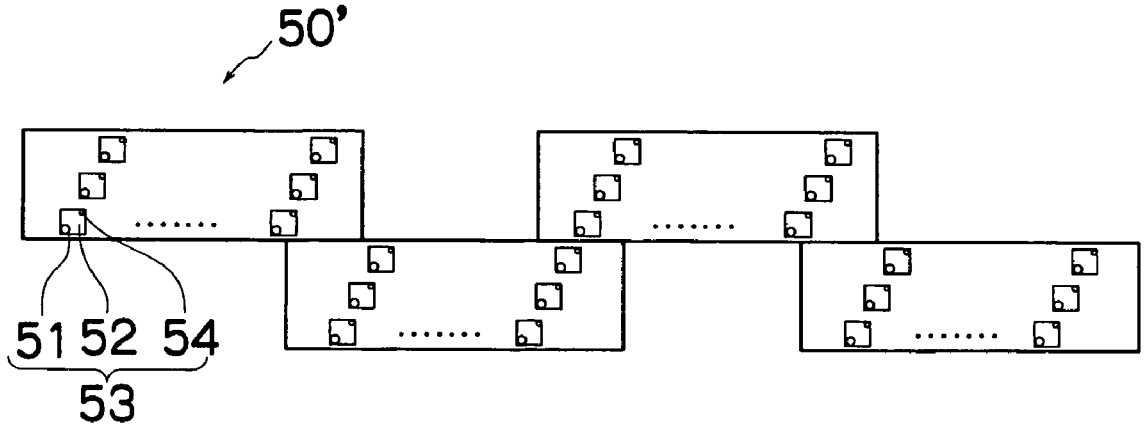
FIG. 5 is a plan view showing another example of a print head.

FIG. 5 is a projected plan view showing a structural example of another print head. As shown in FIG. 5, a plurality of short heads 50' may be arranged two-dimensionally in zigzag form and connected such that the plurality of short heads 50' form a single, elongated full-line head having an overall length which corresponds to the entire width of the print medium.

Figure 6:
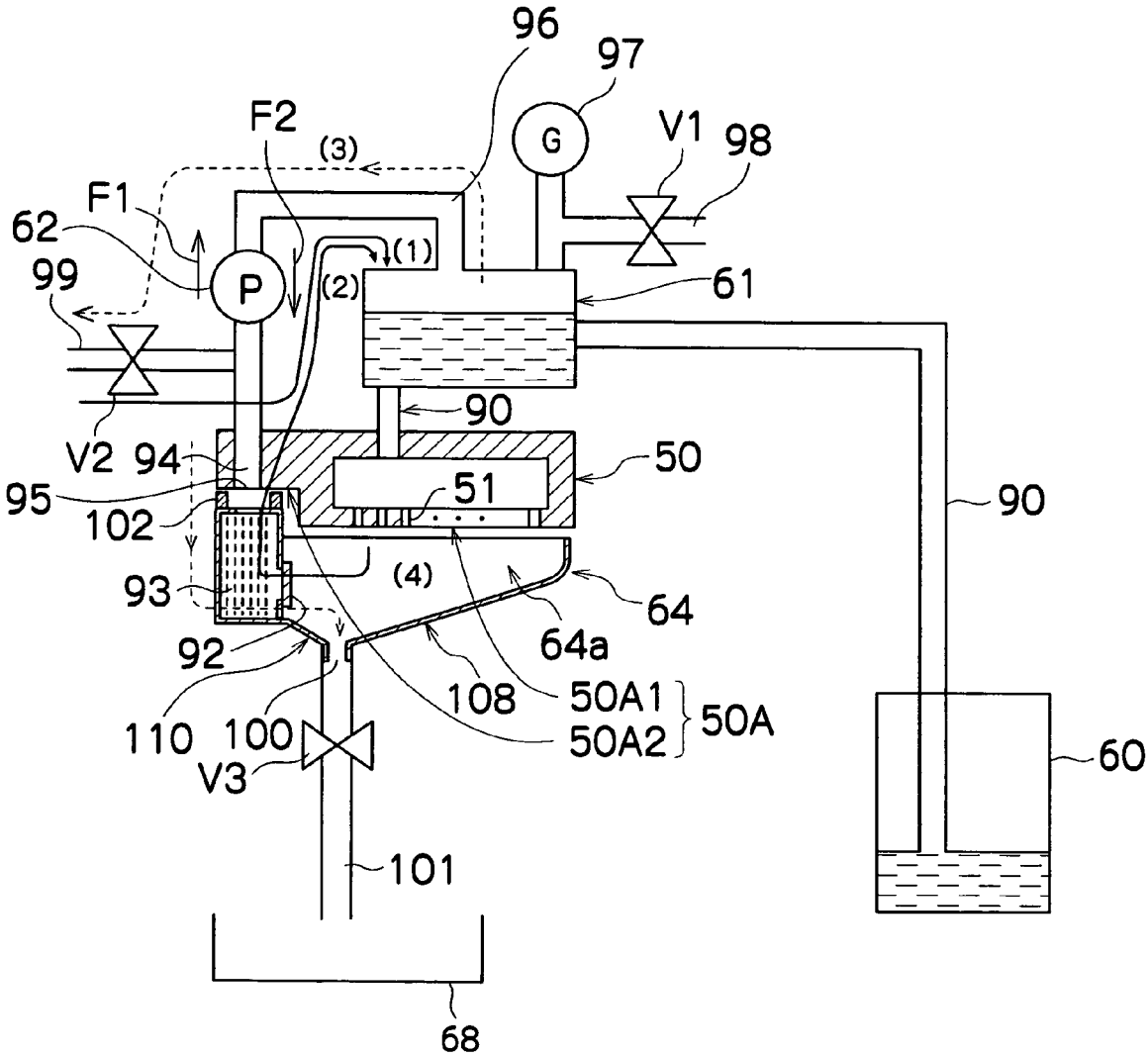
FIG. 6 is a schematic diagram showing the constitution of an ink supply system (and ink circulation system) in the inkjet recording apparatus.

FIG. 6 is a schematic diagram showing the constitution of an ink supply system (and ink circulation system) in the inkjet recording apparatus 10. An ink tank 60 is a base tank that supplies ink to the print head 50, and is disposed in the ink storing and loading unit 14 described with reference to FIG. 1. The aspects of the ink tank 60 include a refillable type and a cartridge type: when the remaining amount of ink is low, the ink tank 60 of the refillable type is filled with ink through a filling port (not shown), and the ink tank 60 of the cartridge type is replaced. When the ink type is to be changed in accordance with the intended application, the cartridge type is preferable. In this case, it is preferable to represent ink type information with a bar code or the like, and to perform ejection control in accordance with the ink type. The ink tank 60 in FIG. 6 is equivalent to the ink storing and loading unit 14 in FIG. 1 described above.

As shown in FIG. 6, a sub-tank 61 which temporarily stores ink to be supplied to the print head 50 is provided in a pipe (ink supply path) 90 connecting the ink tank 60 and print head 50. The sub-tank 61 and print head 50 communicate via the pipe (ink supply path) 90. The sub-tank 61 has a damper function for preventing variation in the internal pressure of the print head 50 and a function for improving refilling of the print head 50.

The sub-tank 61 is not limited to the aspect shown in FIG. 6, and may be provided integrally with the print head 50.

The ink stored in the sub-tank 61 is supplied to the print head 50 through the pipe 90 serving as the ink supply path, and then sent to the pressure chamber 52 (see FIG. 4) through the common flow passage 55, supply port 53, and so on. The ink is then ejected through the nozzle 51 formed in the print head 50. In FIG. 6, to simplify the illustration, the common flow passage 55, supply port 53, and pressure chamber 52 are shown as a single square.

The inkjet recording apparatus 10 is also provided with a cap 64 as a device to prevent the nozzles from drying out or to prevent an increase in the ink viscosity in the vicinity of the nozzles. Further, although not shown in the drawing, a cleaning blade is provided as a device to clean the nozzle face of the print head 50.

An ink ejection-side surface 50A of the print head 50 is constituted by two faces having a step. One of the faces is a nozzle face 50A1 in which the nozzles 51 are formed, and the other face is an ink collection aperture face 50A2 (non-nozzle area) in which an ink collection aperture 95 is formed. An ink collection path 94 for collecting ink suctioned into the cap 64 and returning the ink to the sub-tank 61 is provided on the ink collection aperture face 50A2 side so as to pass through the print head 50. One end of the ink collection path 94 opens onto the ink collection aperture face 50A2 and thus serves as the ink collection aperture 95.

A pipe 96 which connects the print head 50 and sub-tank 61 and thus serves as an ink collection path for returning the ink to the sub-tank 61 from the print head 50 is connected to the other end of the ink collection path 94 provided so as to pass through the print head 50 (ink collection aperture face 50A2), and a pump 62 is provided on this path 96.

As will be described below, the pump 62 functions as a liquid circulation device which circulates ink when the cap 64 is attached tightly to the print head 50 by suctioning the ink into the cap 64 from the print head 50 and returning the suctioned ink to the sub-tank 61 through the ink collection path, and also functions as an internal pressure adjusting device which adjusts the internal pressure of the sub-tank 61.

A maintenance unit including the cap 64 and the cleaning blade (not shown) can be moved relatively to the print head 50 by a movement mechanism (not shown), and is moved from a predetermined holding position to a maintenance position below the print head 50 as required. The cap 64 is displaced up and down relatively to the print head 50 by an elevator mechanism (not shown). When the power of the inkjet recording apparatus 10 is turned OFF or during print standby, the elevator mechanism raises the cap 64 to a predetermined elevated position so as to attach the cap 64 tightly to the print head 50, and thus the nozzle face 50A1 is covered by the cap 64.

The cleaning blade (not shown) is formed from an elastic member made of rubber or the like, and is capable of sliding over the ink ejection face (nozzle face 50A1) of the print head 50 by means of a blade moving mechanism not shown in the drawing. When an ink droplet or foreign object adheres to the nozzle face 50A1, the nozzle face 50A1 can be wiped clean by sliding the cleaning blade over the nozzle face 50A1.

During printing or standby when the frequency of use of a specific nozzle 51 is reduced such that the viscosity of the ink in the vicinity of this nozzle 51 rises, the piezoelectric element 58 is driven to perform a purging operation to eject the degraded ink having the increased viscosity forcibly toward the cap 64 (a purging operation is also known as "preliminary ejection", "dry ejection" "spitting", and so on).

Also, when bubbles become intermixed in the ink inside the print head 50 (inside the pressure chamber 52), the cap 64 is placed on the print head 50, and the pump 62 is driven to remove the ink inside the print head 50 (the ink in which bubbles have become intermixed) by suctioning the ink to the cap 64 side. This suction operation is performed by the pump 62 when ink is initially loaded into the head (at the time of first loading), or when usage is resumed after a long stoppage. The hardened, degraded ink whose viscosity has increased is suctioned to the cap 64 side.

When ejection is not performed from the print head 50 for a certain time period or longer, the ink solvent in the vicinity of the nozzle evaporates, causing the viscosity of the ink in the vicinity of the nozzle to rise. In this situation, ink can no longer be ejected from the nozzle 51 even when an ejection driving actuator (the piezoelectric element 58) is driven. Before such a situation arises (when the ink is within a viscosity range that enables the ink to be ejected by an operation of the piezoelectric element 58), a purging operation such as that described above is performed by operating the piezoelectric element 58 to eject the viscous ink in the vicinity of the nozzle toward the cap 64. A purging operation is also performed after the nozzle face 50A1 has been cleaned by a wiper such as the cleaning blade, which is provided as a device for cleaning the nozzle face 50A, to prevent foreign matter from entering the nozzle 51 as a result of the sliding motion of the wiper.

When bubbles become mixed into the nozzle 51 and pressure chamber 52 (see FIG. 4) or the viscosity of the ink in the nozzle 51 rises above a certain level so that the ink cannot be ejected by a purging operation, the cap 64 is attached tightly to the print head 50 and the pump 62 is driven to perform a suction operation.

The ink that is collected in the cap 64 by the purging operation or suction operation is suctioned up into the ink collection path 94 by the pump 62 through the ink collection aperture 95 while the cap 64 is still attached tightly to the print head 50, and then returned to the sub-tank 61 through the pipe 96. Thus the ink is circulated by the pump 62.

The cap 64 is formed with a step corresponding to the step in the ink ejection-side surface 50A of the print head 50, which is constituted by the nozzle face 50A1 and the ink collection aperture face 50A2, and thus the cap 64 is divided into a part (opening portion 64*a*) for receiving the ink that is suctioned out of the print head 50 (nozzles 51), which corresponds to the nozzle face 50A1, and a part which corresponds to the ink collection aperture face 50A2. A filter 92 for removing foreign matter, air bubbles, and so on is provided between the two parts. There are no particular limitations on the filter 92, but a mesh filter with a mesh size that is equal to or smaller than the nozzle diameter of the print head 50 (typically approximately 20 μm) is preferable.

The ink that is suctioned into the cap 64 often contains foreign matter or air bubbles, and therefore, by passing the ink through the filter 92, it is possible to circulate only reusable ink to the sub-tank 61.

The cap 64 is also provided with an ink holding structure 93 which is positioned between the filter 92 and ink collection aperture 95 when the cap 64 is attached tightly to the print head 50. The ink holding structure 93 facilitates ink collection by leading the ink that passes through the filter 92 to the vicinity of the ink collection aperture 95.

There are no particular limitations on the ink holding structure 93, and for example, the ink may be suctioned up to the vicinity of the ink collection aperture 95 naturally by a capillary tube structure. Examples of the ink holding structure 93 include a porous member or a capillary tube member formed in a rib form extending upward from the bottom face of the cap 64 on the rear side of the filter 92 to the vicinity of the ink collection aperture 95.

The ink that is suctioned up to the vicinity of the ink collection aperture 95 through the ink holding structure 93 is returned to the sub-tank 61 by the pump 62 from the ink collection path 94 through the pipe 96, and then re-supplied to the print head 50 from the sub-tank 61. By circulating the ink in this manner, the amount of wasted ink can be reduced.

A sealing member 102 made of rubber packing or the like is disposed on the part of the cap 64 which contacts the ink collection aperture face 50A2 to ensure air-tightness.

An air opening 98 and an air valve V1 are provided for the sub-tank 61. An air opening 99 and an air valve V2 are also provided in the pipe 96 between the print head 50 and pump 62. The pump 62 acts to adjust the internal pressure of the sub-tank 61. By providing a pressure gauge 97 for measuring the internal pressure inside the sub-tank 61, pressure control can be performed with a higher degree of accuracy. Instead of using a pressure gauge, a method in which a part of the sub-tank is constituted by a flexible member, and the displacement of the flexible member is sensed, may be employed.

Of the ink that is collected in the cap 64, ink with a high degree of viscosity and foreign matters or the like must not be circulated, and therefore a drain port 100 is provided on the bottom portion of the cap 64 for discharging such ink and foreign matters. The bottom portion of the cap 64 is formed by surfaces 110, 108 that are inclined respectively from the filter 92 side and the opening portion 64*a* side, which receives the ink that is suctioned out from the nozzle 51. The two inclined surfaces 110 and 108 meet in the vicinity of the filter 92 side, and the drain port 100 is formed in the lowest portion between the inclined surfaces 110 and 108. Hence the ink flows naturally toward the drain port 100 under its own weight. An ink discharge path 101 is connected to the drain port 100. A drain valve V3 is provided on the ink discharge path 101.

A discarded ink tank 68 is disposed at the end of the ink discharge path 101, and by opening the drain valve V3, the ink that is discarded through the drain port 100 passes along the ink discharge path 101 to be discharged into the discarded ink tank 68.

Figure 7:
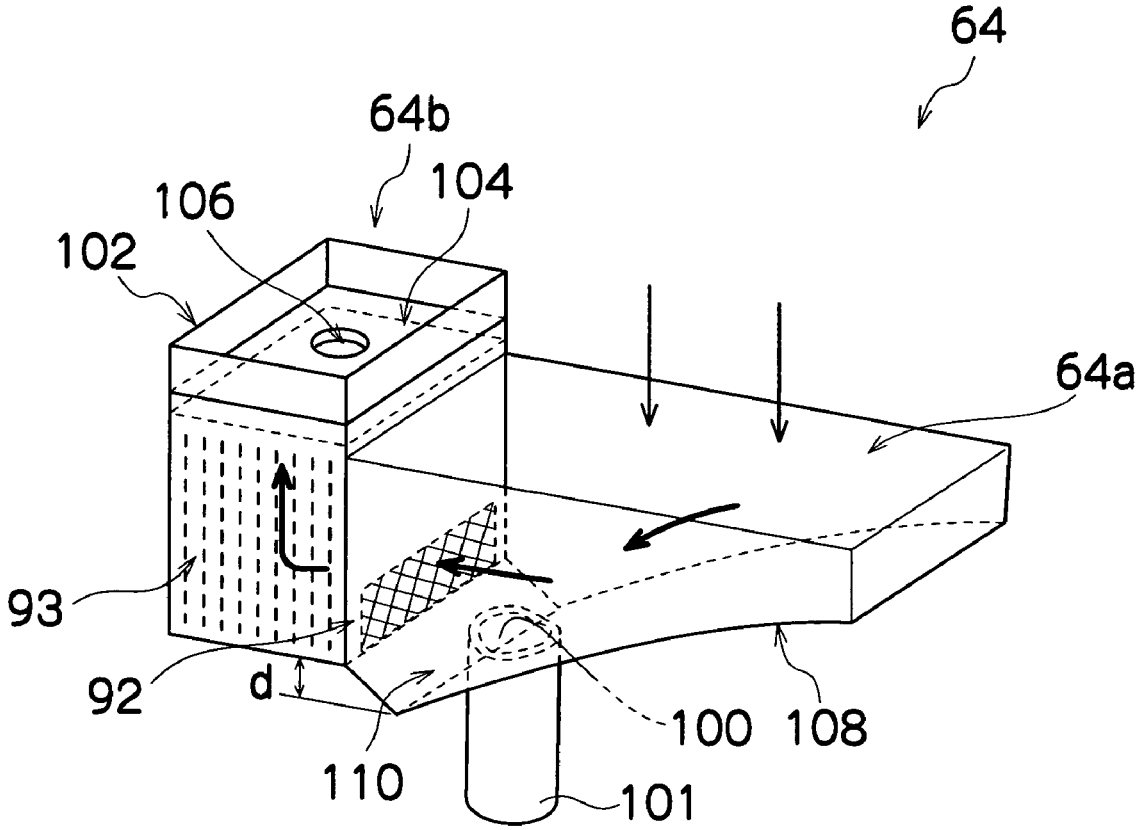
FIG. 7 is an enlarged perspective view showing a cap of this embodiment.

FIG. 7 is an enlarged perspective view of the cap 64.

As shown in FIG. 7, the upper portion of the cap 64 takes a rectangular form matching the nozzle face 50A of the print head 50, and rubber packing 102 for ensuring air-tightness is annexed to its periphery. The part of the upper portion of the cap 64 corresponding to the nozzle area 50A1 of the nozzle face 50A in which the nozzles 51 are formed serves as the opening portion (liquid reception side) 64*a* for receiving the ink that is ejected from the nozzles 51. A plate material 104 is disposed on the part of the upper portion of the cap 64 corresponding to the non-nozzle area 50A2 of the nozzle face 50A, and the aforementioned ink-collecting ink holding structure 93 is disposed under the plate material 104. An aperture 106 corresponding to the ink collection aperture 95 provided in the nozzle face 50A is provided in the center of the plate material 104.

When the cap 64 is attached tightly to the print head 50, this aperture 106 matches the ink collection aperture 95 in the nozzle face 50A of the print head 50. The ink that has been raised to the upper portion of the cap 64 by the ink holding structure 93 flows into the ink collection path 96 through the aperture 106 and ink collection aperture 95.

The bottom face in the lower portion of the opening portion 64*a* for receiving the ink serves as the inclined surface 108, which inclines steadily downward toward the side on which the ink holding structure 93 is disposed. The part directly in front of the filter 92 serves as the inclined surface 110, and the drain port 100 is provided in the lowest part at which the two inclined surfaces 108 and 110 meet. The ink discharge path 101 is connected to the drain port 100.

A partitioning plate 112 is provided between the opening portion 64*a* for receiving ink and the ink holding structure 93, and the filter 92 is provided beneath this partitioning plate 112. There are no particular limitations of the form of the filter 92, but that shown in FIG. 7 takes a substantially rectangular form, and the lower edge thereof is positioned higher than the disposal position of the drain port 100 by a distance d.

The slight distance d between the lower edge of the filter 92 and the disposal position of the drain port 100 is provided to prevent accumulated foreign matter from being circulated. Accordingly, to facilitate discharge of the accumulated foreign matter from the apparatus, the vicinity of the drain port 100 preferably takes a funnel form with the drain port 100 disposed in the lowest position and the surfaces on the periphery thereof being inclined.

As shown by the arrows in FIG. 7, when ink is to be circulated by attaching the cap 64 tightly to the print head 50, the ink that is ejected through the nozzles 51 is taken into the opening portion 64*a*, flows downward along the inclined surface 108, passes through the filter 92, is raised upward by the capillary tube phenomenon of the ink holding structure 93, and is then collected through the aperture 106 and the ink collection aperture 95 in the print head 50.

Figure 8:
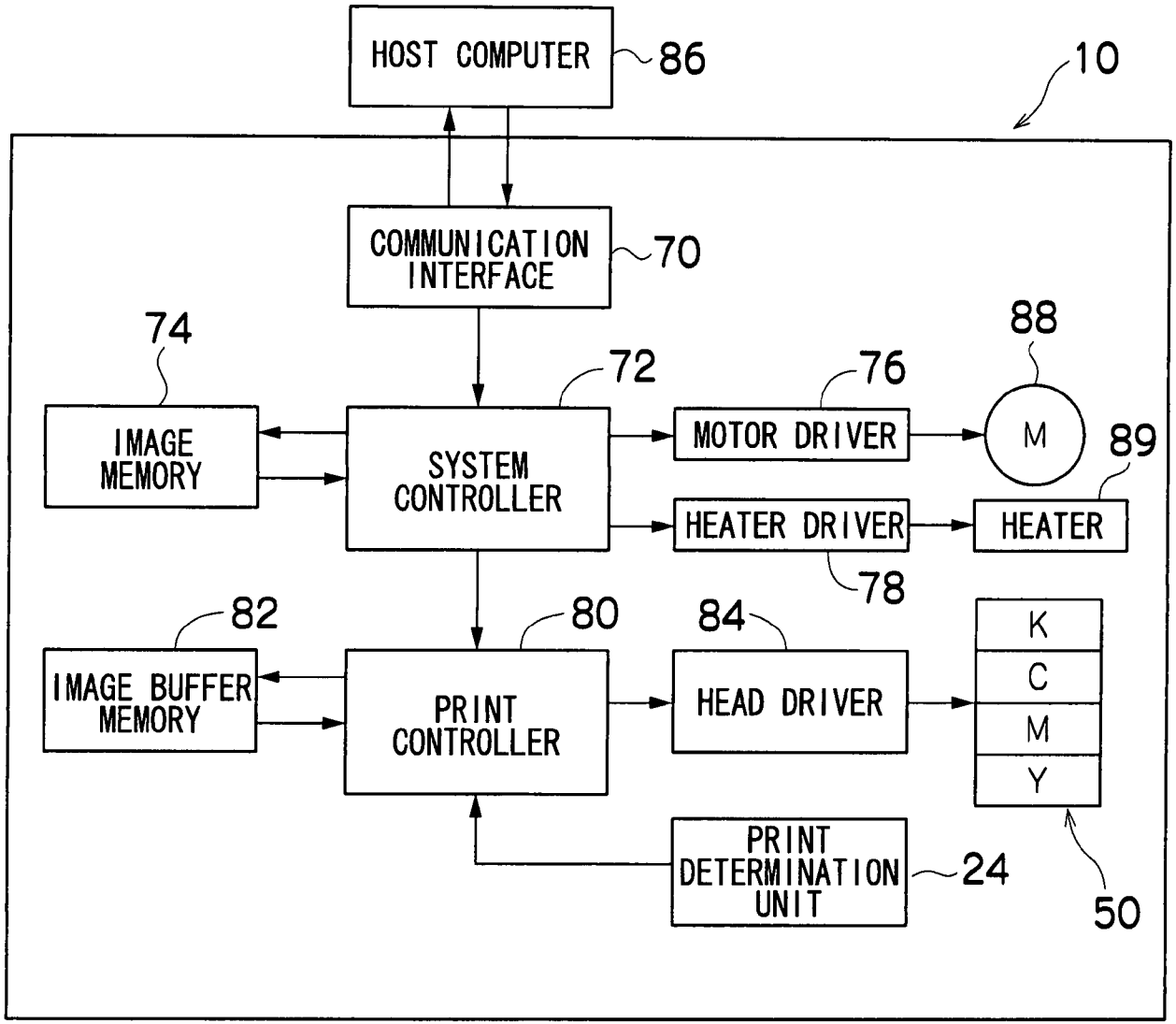
FIG. 8 is a principal block diagram showing the system constitution of the inkjet recording apparatus.

FIG. 8 is a principal block diagram showing the system configuration of the inkjet recording apparatus 10. The inkjet recording apparatus 10 comprises a communication interface 70, a system controller 72, an image memory 74, a motor driver 76, a heater driver 78, a print controller 80, an image buffer memory 82, a head driver 84, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet et recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is a control unit for controlling various units such as the communication interface 70, image memory 74, motor driver 76, and heater driver 78. The system controller 72 is constituted by a central processing unit (CPU), peripheral circuits thereof, and so on, and controls communication with the host computer 86 and writing and reading to and from the memory 74. The system controller 72 also generates control signals for controlling the motor 88 and heater 89 of the conveyance system.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to supply the generated print control signal (print data) to the head driver 84. Prescribed signal processing is carried out in the print controller 80, and the ejection amount and the ejection timing of the ink droplets from the respective print heads 50 are controlled via the head driver 84, on the basis of the print data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 8 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the piezoelectric element 58 of the print heads 50 of the respective colors on the basis of print data supplied by the print controller 80. The head driver 84 can be provided with a feedback control system for maintaining constant drive conditions for the print heads.

The print determination unit 24 is a block that includes the line sensor, as described in FIG. 1, reads the image printed on the recording paper 16, determines the print conditions (presence of the ejection, variation in the dot formation, and the like) by performing desired signal processing or the like, and provides the determination results of the print conditions to the print controller 80.

When necessary, the print controller 80 performs various corrections on the print head 50 on the basis of information obtained from the print determination unit 24.

Next, actions of this embodiment will be described.

First, an ink circulation mode in which ink is circulated, the nozzles are cleaned, and air bubbles are removed from the interior of the head will be described following the flowchart in FIG. 9.

Figure 9:
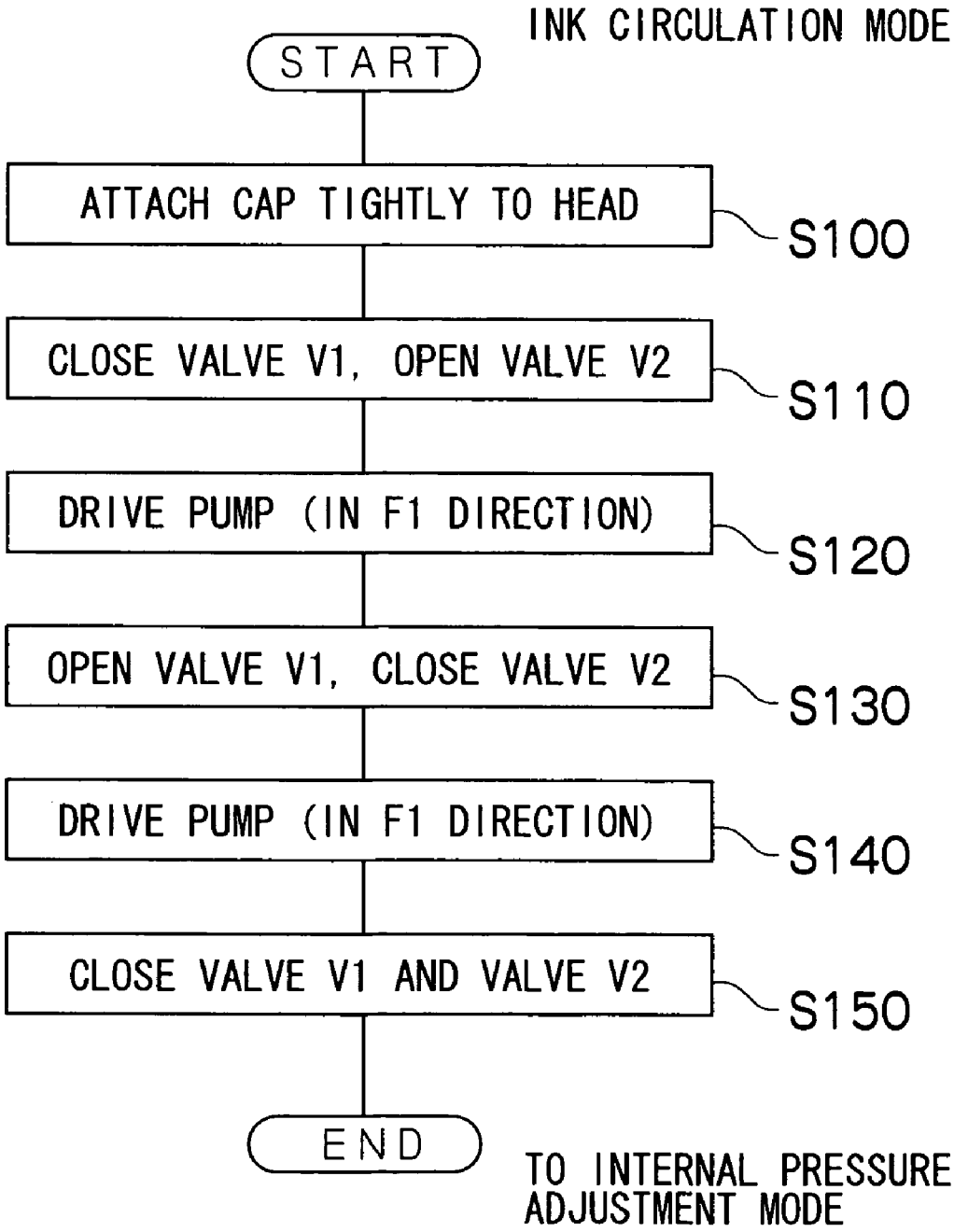
FIG. 9 is a flowchart showing an action performed in a filter cleaning mode of the ink supply system in the inkjet recording apparatus.

First, in a step S100 of FIG. 9, the part of the cap 64 corresponding to the ink collection aperture face 50A2 on the ink ejection-side surface 50A of the print head 50 is attached tightly thereto. At this time, the part of the cap 64 corresponding to the nozzle face 50A1 is not attached tightly thereto.

Next, in a step S110, the air valve V1 is closed and the air valve V2 is opened. Then, in a step S120, the pump 62 is driven to make flow in the direction shown by an arrow F1 in FIG. 6. The operation period of the pump 62 at this time is set on a timer. By driving the pump 62, the interior of the sub-tank 61 is pressurized, and this pressure is applied to the ink in the pressure chamber 52 of the print head 50. As a result, the ink is ejected from the nozzle 51 into the opening portion 64*a* (see FIG. 7) of the cap 64 and collected in the cap 64.

Next, in a step S130, the air valve V1 is opened and the air valve V2 is closed. Then, in a step S140, the pump 62 is driven to make the flow in the direction shown by an arrow F1 in FIG. 6 for a period of time set by a timer. At this time, the ink that has been pushed out into the opening portion 64*a* of the cap 64 descends along the inclined surface 108, passes through the filter 92, and is raised up to the vicinity of the ink collection aperture 95 by the capillary tube phenomenon of the ink holding structure 93. As a result of the drive of the pump 62, the ink is suctioned through the ink collection aperture 95 provided in the ink collection aperture face 50A2 of the print head 50, and returned to the sub-tank 61 through the ink collection path 94 and the pipe 96.

Finally, in a step S150, both of the air valves V1 and V2 are closed, and the process moves to an internal pressure adjustment mode. The flow of ink in the ink circulation mode is shown by the solid-line arrows (1) and (2) in FIG. 6. Ink circulation is performed in this manner.

When a certain amount of highly viscous ink and ink containing foreign matter, air bubbles, and so on, which cannot be reused, has accumulated in the bottom portion 110 of the cap 64 (see FIG. 7), the drain valve V3 provided on the ink discharge path 101 is opened appropriately to discharge this ink through the drain port 100 to the discarded ink tank 68.

Next, an action performed during adjustment of the internal pressure of the sub-tank 61 (in internal pressure adjustment mode) will be described following the flowchart in FIG. 10.

Figure 10:
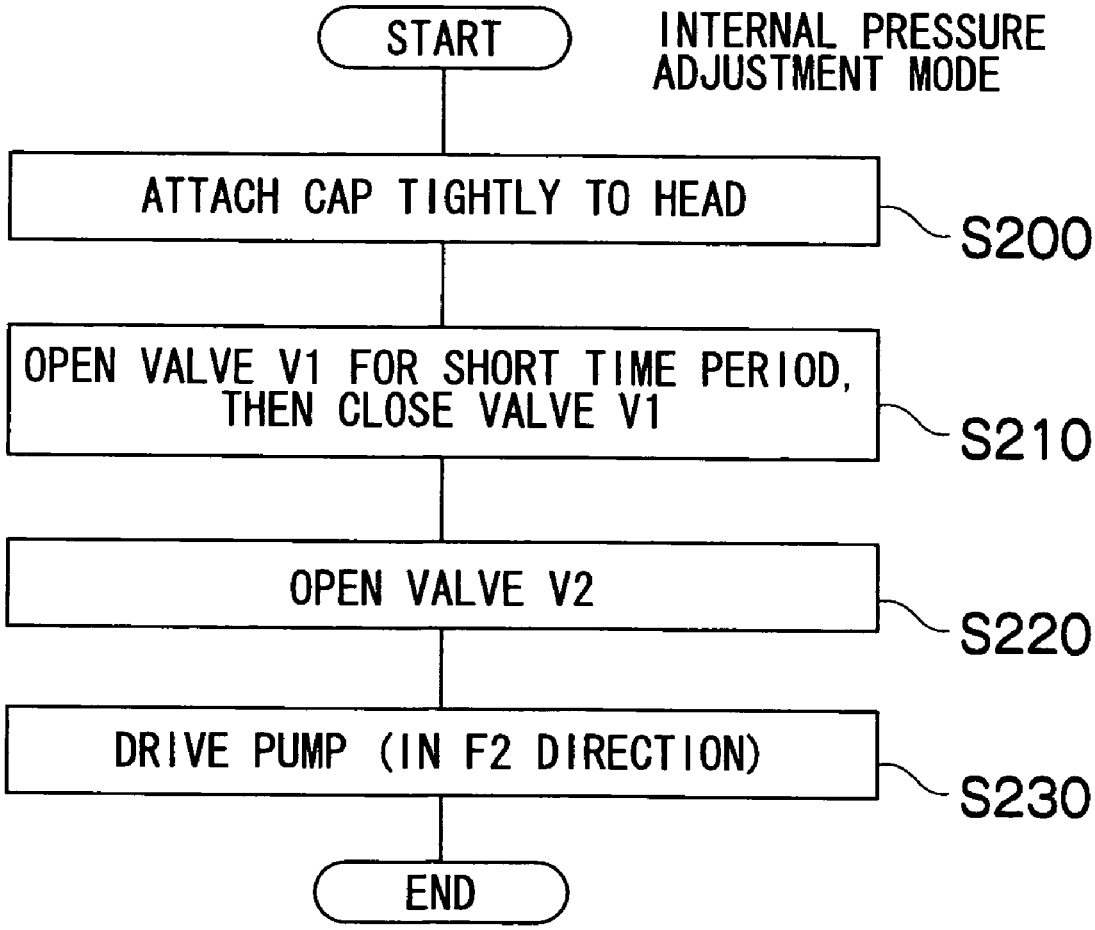
FIG. 10 is a flowchart showing an action performed in an internal pressure adjustment mode of the ink supply system in the inkjet recording apparatus.

First, in a step S200 of FIG. 10, the part of the cap 64 corresponding to the ink collection aperture face 50A2 of the print head 50 is attached tightly thereto. At this time, the part of the cap 64 corresponding to the nozzle face 50A1 is not attached tightly thereto.

Next, in a step S210, the air valve V1 is opened for a short time period to return the interior of the sub-tank 61 to the atmospheric pressure, and then closed. This operation is performed to return the internal pressure of the sub-tank 61 to normal when the internal pressure decreases excessively.

Next, in a step S220, the air valve V2 is opened, and in a step S230, the pump 62 is driven to make the flow in the direction of an arrow F2 in FIG. 6. The amount of time that the pump 62 is driven is set in advance on a timer, as described above. As a result of the drive of the pump 62, the air in the interior of the sub-tank 61 is discharged outside through the air valve V2, whereby the internal pressure of the sub-tank 61 decreases. A minute amount of ink remaining in the pipe may also be discharged outside through the air opening 99, and therefore an ink suction member is placed at the outlet of the air opening 99. The flow of air in the internal pressure adjustment mode is shown by the broken-line arrow (3) in FIG. 6. As a result of the internal pressure adjustment mode, the internal pressure of the sub-tank 61 is adjusted to a predetermined value.

Figure 11:
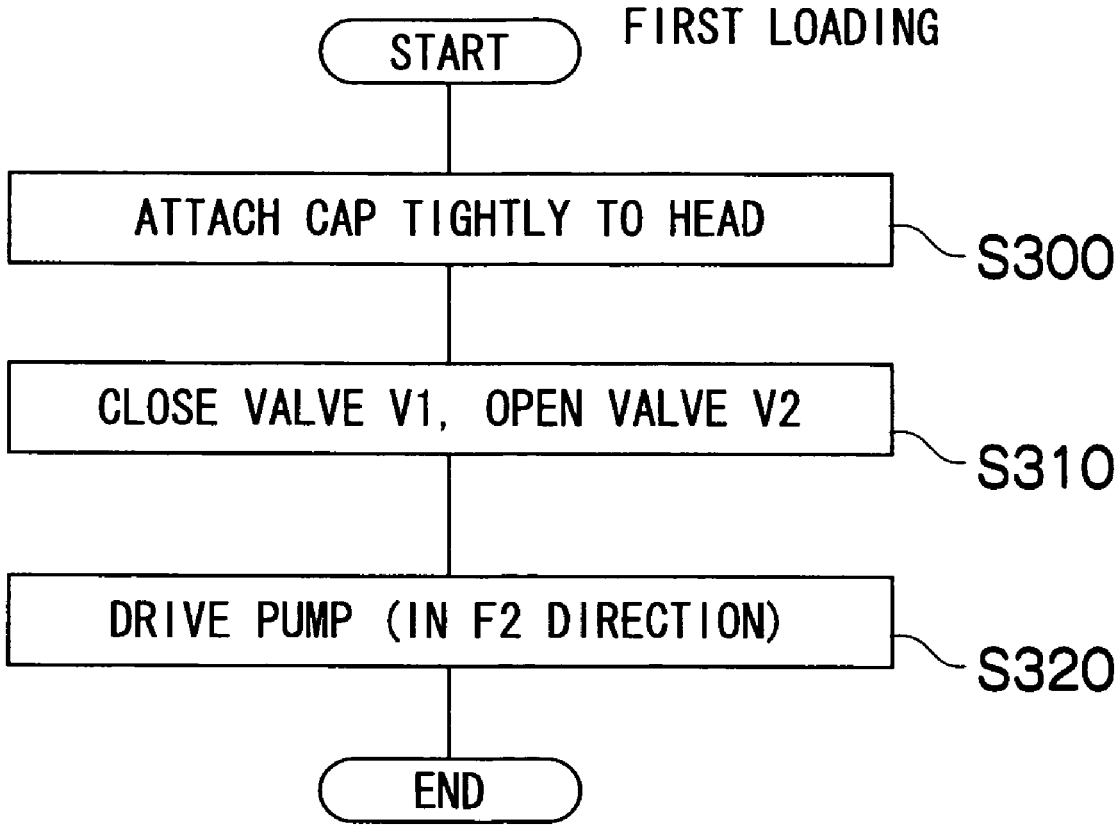
FIG. 11 is a flowchart showing an action performed during first loading in the ink supply system of the inkjet recording apparatus.

Next, an action performed during first loading will be described following the flowchart shown in FIG. 11.

At this time, no ink yet exists in the sub-tank 61. First, in a step S300 of FIG. 11, the part of the cap 64 corresponding to the ink collection aperture face 50A2 of the print head 50 is attached tightly thereto. At this time, the part of the cap 64 corresponding to the nozzle face 50A1 is not attached tightly thereto.

Next, in a step S310, the air valve V1 is closed and the air valve V2 is opened. Then, in a step S320, the pump 62 is driven to make the flow in the direction shown by the arrow F2 in FIG. 6. As a result, the air in the interior of the sub-tank 61 is discharged to the outside through the air opening 99, the internal pressure of the sub-tank 61 decreases, the atmospheric pressure acting on the ink in the ink tank 60 becomes relatively larger, and hence the ink in the ink tank 60 is led into the sub-tank 61 along the ink supply path 90.

The amount of time that the pump 62 is driven is set in advance on a timer, and when the predetermined time period has elapsed, the pump 62 is stopped. The process may then move to the ink circulation mode described above, for example. Here, a timer is used to set the drive time of the pump, but a sensor which determines the presence of ink in the sub-tank may be provided so that the pump is controlled by the output of the sensor.

Finally, a filter cleaning mode will be described following the flowchart in FIG. 12, with reference to FIG. 6 or FIG. 13.

The filter cleaning mode is provided for cases in which the filter 92 in the cap 64 becomes blocked after long-term usage. The filter cleaning mode is performed periodically to release the blockage in the filter 92 by cleaning the filter 92.

Figure 13:
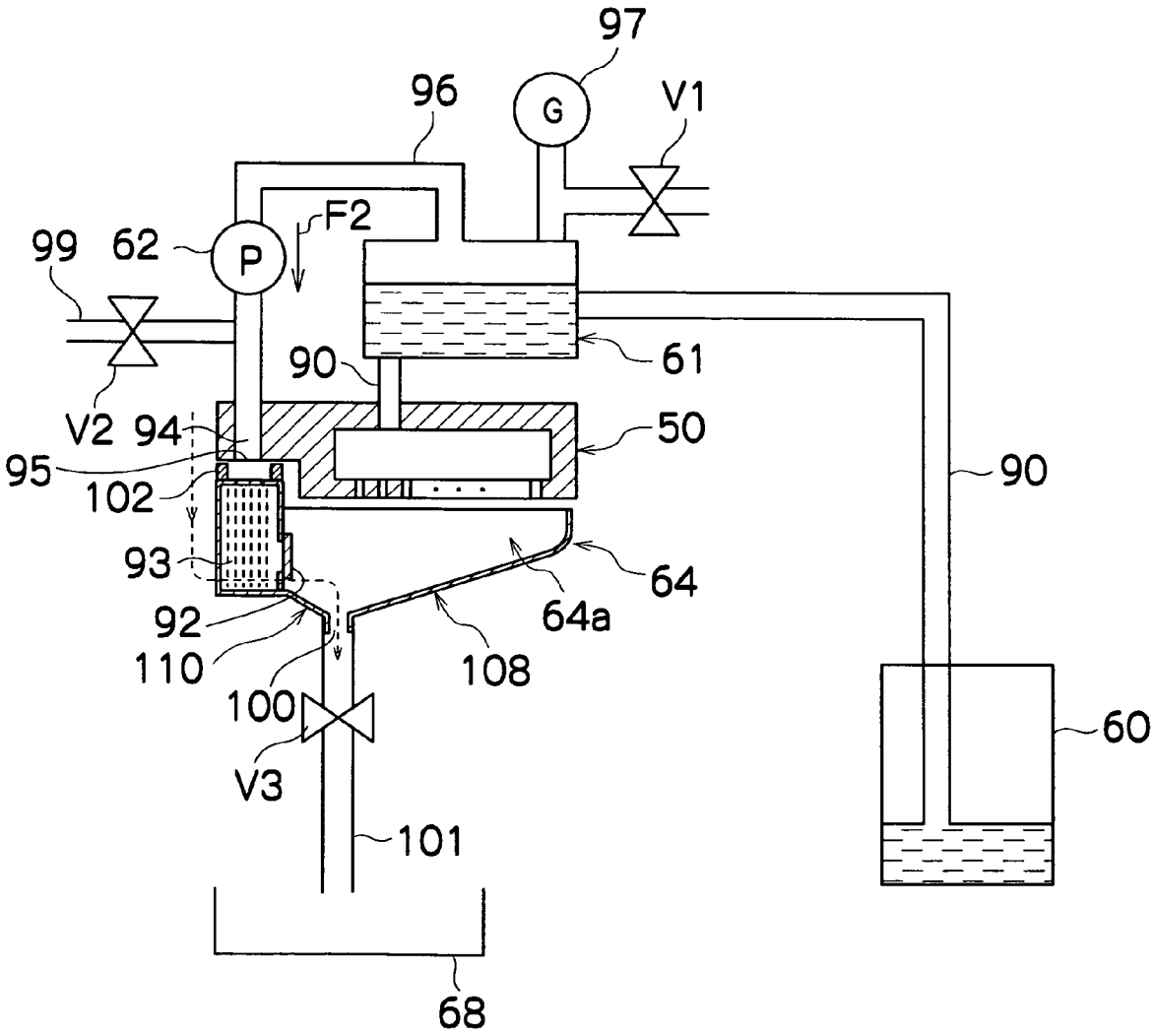
FIG. 13 is a schematic diagram showing an operation of the ink supply system and the ink flow in the filter cleaning mode.

FIG. 13 shows an operation of the ink supply system and the flow of ink during the filter cleaning mode.

Figure 12:
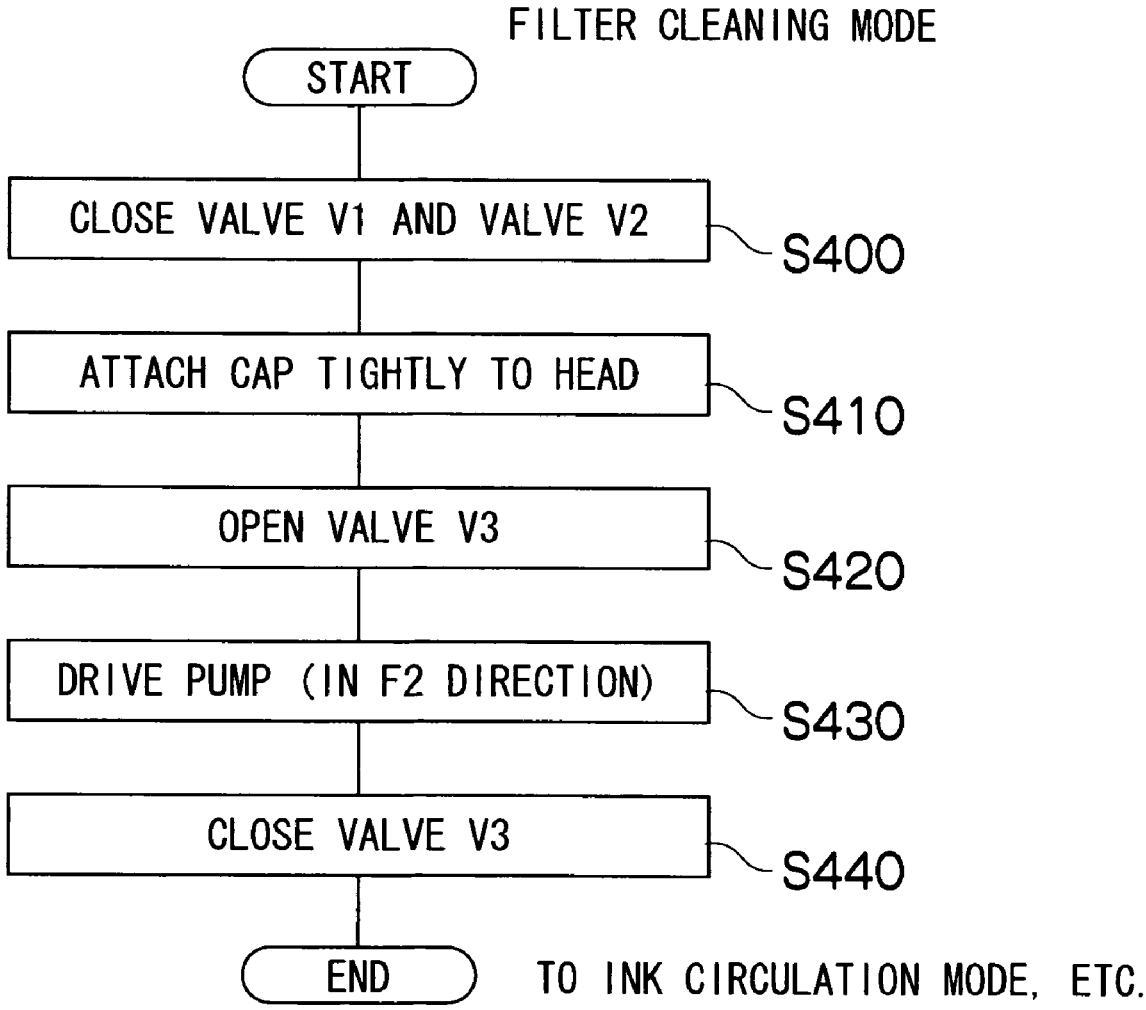
FIG. 12 is a flowchart showing an action performed in the filter cleaning mode of the ink supply system in the inkjet recording apparatus.

First, in a step S400 of FIG. 12, the air valves V1 and V2 are closed, and then, in a step S410, the part of the cap 64 corresponding to the ink collection aperture face 50A2 of the print head 50 is attached tightly thereto. At this time, the part of the cap 64 corresponding to the nozzle face 50A1 is not attached tightly thereto.

Next, in a step S420, the drain valve V3 is opened, and in a step S430, the pump 62 is driven to make the flow in the direction of the arrow F2 in FIG. 13. The amount of time that the pump 62 is driven is set in advance on a timer, as described above.

By driving the pump 62 to make the flow in the direction of the arrow F2 in FIG. 13, the ink in the ink tank 60 is supplied to the sub-tank 61 along the ink supply path 90. If the pump 62 continues to be driven, ink overflows from the sub-tank 61, and the ink overflow passes through the pump 62 from the pipe 96 serving as an ink collection path, passes through the ink collection path 94 in the print head 50 and the ink holding structure 93 in the cap 64, and thus reaches the filter 92.

During ink circulation, the ink passes through the filter 92 from the opening portion 64*a* side of the cap 64 to the ink holding structure 93 side (from right to left in FIG. 13), but during filter cleaning, the ink passes through the filter 92 in the opposite direction, i.e., from left to right in FIG. 13.

By causing ink to flow through the filter 92 from the rear side, i.e., in the opposite direction to the direction during normal filter usage, the refuse and so on attached to the drain side of the filter 92 (the opening portion 64*a* side of the cap 64 on the right side of FIG. 13) are discharged into the discarded ink tank 68 through the drain port 100 and along the ink discharge path 101 by opening the drain valve V3. The flow of ink in the filter cleaning mode is shown by the broken-line arrow (4) in FIG. 6 and the broken-line arrow in FIG. 13.

The drive period of the pump 62 is managed by setting the drive period in advance on a timer. As a result, the drive of the pump 62 is stopped once the predetermined period has elapsed. Next, in a step S440, the drain valve V3 is closed, the cap 64 is removed from the print head 50, and the process moves to another mode such as the ink circulation mode or internal pressure adjustment mode, for example.

According to this embodiment, as described above, the ink collection path which circulates the ink from the cap to the sub-tank is provided so as to pass through the (ink collection aperture face of the) print head, and therefore the ink collection path does not have to be wound around the print head, as in the prior art, enabling a reduction in the length of the ink collection path. Furthermore, the ink collection pump also serves as an internal pressure adjusting pump, enabling simplification of the ink circulation system, space-saving, and a reduction in cost.

Further, since the ink collection path (ink circulation path) is reduced in length and the ink collection path is formed so as to pass through the (ink collection aperture face of the) print head, the ink can be returned to the sub-tank without being exposed to the air. Moreover, effects on the viscosity, surface stress, and other performance factors of the ink can be reduced to a minimum.

In the above embodiment, the filter and ink support structure are provided separately, but the ink support structure may be constituted to function as a filter.

Further, the ink collection aperture 95 formed in the nozzle face 50A of the print head 50 may also be used as a positioning aperture when assembling the head.

Next, a modified example of this embodiment will be described.

Figure 14:
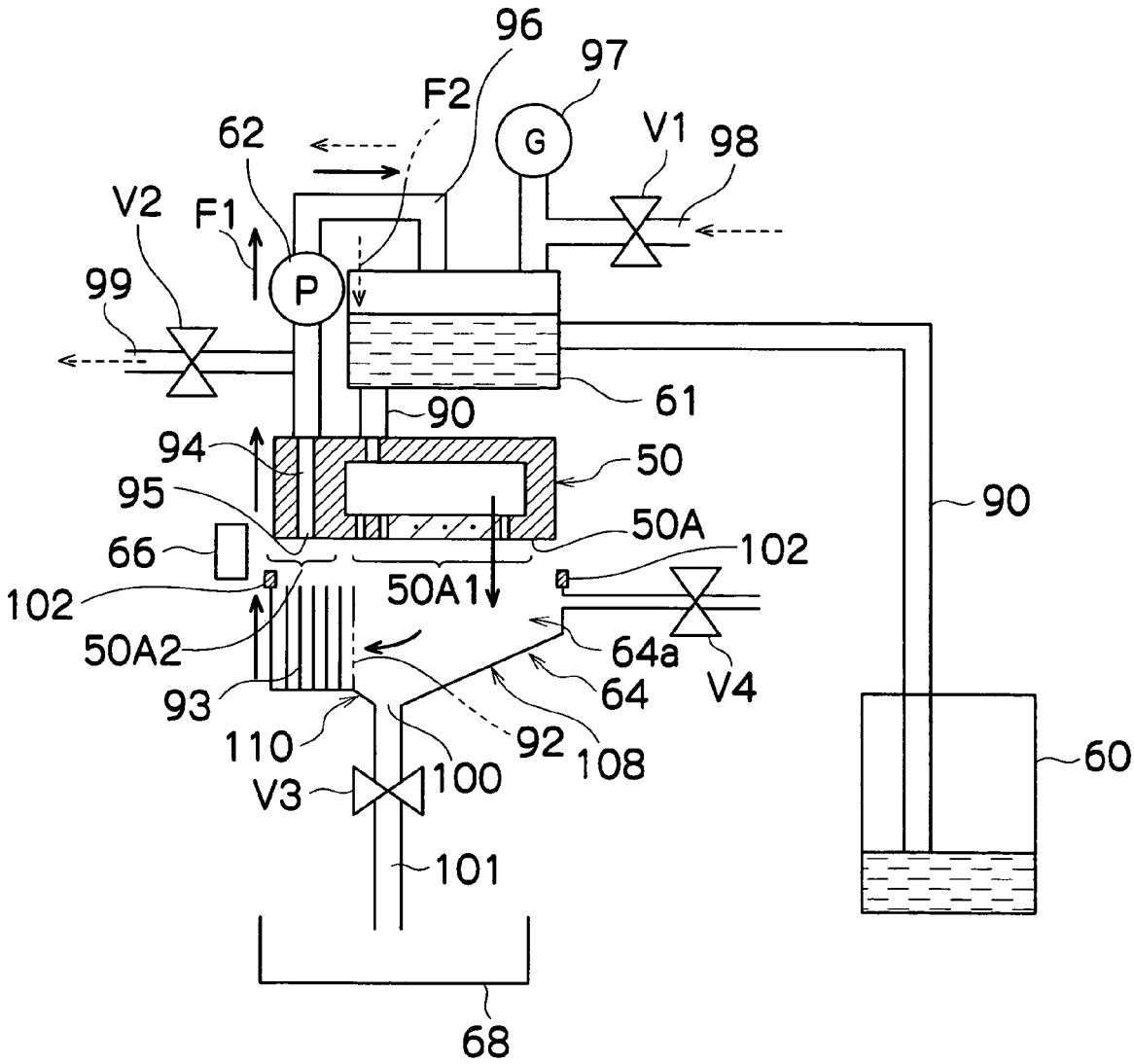
FIG. 14 is a schematic diagram showing the constitution of an ink supply system (and ink circulation system) in a modified example of this embodiment.

FIG. 14 is a schematic diagram showing the constitution of an ink supply-circulation system in this modified example.

The constitution shown in FIG. 14 is basically identical to the constitution shown in FIG. 6, but differs in that the ink ejection-side surface 50A of the print head 50 is formed as a single plane without a step, and in that the nozzle 51 and ink collection aperture 95 are formed on substantially the same plane. Here, the cap 64 is tightly attached to the entire ink ejection-side surface 50A of the print head 50, and therefore an air valve V4 for releasing the interior of the cap 64 to the atmospheric pressure is provided so that when the cap 64 is removed from the print head 50, the cap 64 can be removed more easily.

In this modified example, by disposing the nozzle 51 and ink collection aperture 95 on the same plane (the ink ejection-side surface 50A without the step) as shown in FIG. 14, the cap 64 can be tightly attached to the nozzle face 50A1 and ink collection face 50A2. Thus the seal which attracts the ink may also serve to collect the ink. Moreover, cleaning through ink suction can be performed. As a result, an improvement in reliability is achieved. It is also possible to wipe the vicinity of the ink collection aperture 95.

Following the flowchart in FIG. 15, an action of the ink circulation mode according to the constitution shown in FIG. 14 will now be described.

Figure 15:
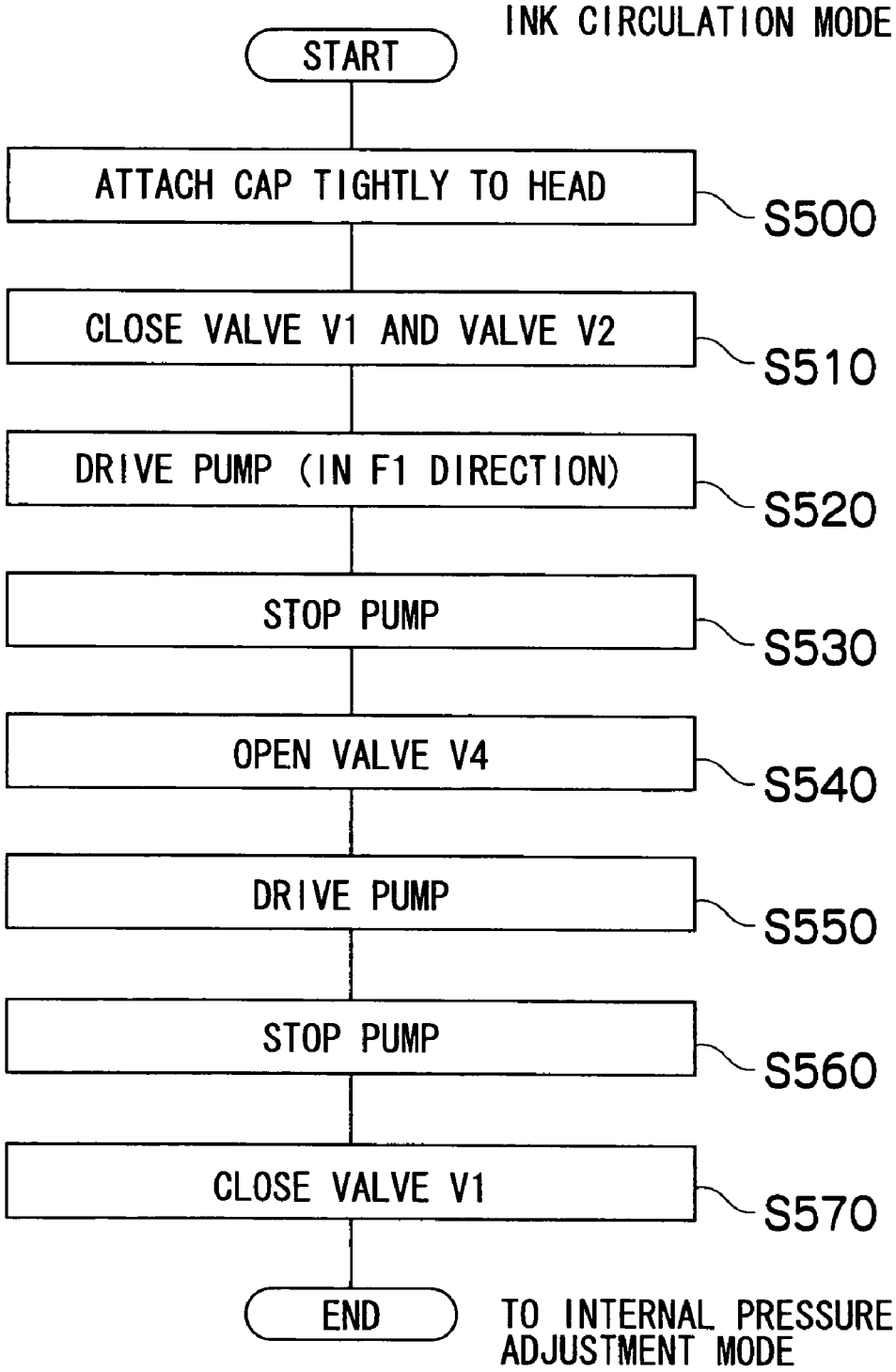
FIG. 15 is a flowchart showing an action performed during an ink circulation mode in the ink supply system shown in FIG. 14.

First, in a step S500 of FIG. 15, the cap 64 is attached tightly to the print head 50. In this embodiment, the nozzle 51 and ink collection aperture 95 are disposed on the same plane (the ink ejection-side surface 50A without the step), and therefore the part of the cap 64 which contacts the ink ejection face 50A takes a corresponding step-less form. Therefore, at this time the cap 64 is attached tightly to the nozzle face 50A1 as well as the ink collection face 50A2.

Next, in a step S510, the air valves V1 and V2 are both closed, and then, in a step S520, the pump 62 is driven to make the flow in the direction of the arrow F1 in the drawing to move the ink in the sub-tank 61 to the cap 64 side. Next, in a step S530, the pump 62 is stopped after the predetermined time period has elapsed.

Next, in a step S540, the air valve V4 is opened, and in a step S550, the pump 62 is driven to make the flow in the same direction of the arrow F1 to return the ink that has gathered in the cap 64 to the sub-tank 61 side along the ink collection path.

Next, in a step S560, the pump 62 is stopped after the predetermined time period has elapsed, and in a step S570 the air valve V1 is closed. The processing is then terminated. Thereafter, the process moves to the internal pressure adjustment mode or the like, for example.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

an ejection head which includes a plurality of nozzles to eject a liquid to deposit the liquid on a recording medium being conveyed relatively to the ejection head to form an image on the recording medium;

a tank which stores the liquid to be supplied to the nozzles and has an adjustable internal pressure;

a liquid supply path which connects the tank and the ejection head;

a cap which faces a nozzle face on which the nozzles of the ejection head are formed;

a liquid collection path which is capable of connecting the cap and the tank; and a liquid circulating device which is provided on the liquid collection path, collects the liquid in the ejection head through the cap, circulates the liquid to the tank along the liquid collection path, and adjusts the internal pressure of the tank to a desired value.

2. An image forming apparatus, comprising:

an ejection head which includes a plurality of nozzles to eject a liquid to deposit the liquid on a recording medium being conveyed relatively to the ejection head to form an image on the recording medium;

a tank which stores the liquid to be supplied to the nozzles and has an adjustable internal pressure;

a liquid supply path which connects the tank and the ejection head;

a cap which faces a nozzle face on which the nozzles of the ejection head are formed;

a liquid collection path which is capable of connecting the cap and the tank, wherein the liquid collection path is provided so as to partly pass through the ejection head, thereby connecting the cap and the tank when the cap is attached tightly to a surface of the ejection head in which an ink collection aperture is provided; and a liquid circulating device which is provided on the liquid collection path, collects the liquid in the ejection head through the cap, circulates the liquid to the tank alone the liquid collection path, and adjusts the internal pressure of the tank to a desired value.

3. The image forming apparatus as defined in claim 2, wherein the nozzles and the ink collection aperture are provided on a substantially same plane.

4. An image forming apparatus, comprising:

an ejection head which includes a plurality of nozzles to eject a liquid to deposit the liquid on a recording medium being conveyed relatively to the ejection head to form an image on the recording medium;

a tank which stores the liquid to be supplied to the nozzles and has an adjustable internal pressure;

a liquid supply path which connects the tank and the ejection head;

a cap which faces a nozzle face on which the nozzles of the ejection head are formed, wherein a part of the cap corresponding to an opening portion of the liquid collection path provided in the nozzle face when the cap is attached tightly to the nozzle face of the ejection head comprises a liquid holding structure which moves the liquid in the cap toward the opening portion;

a liquid collection path which is capable of connecting the cap and the tank; and a liquid circulating device which is provided on the liquid collection path, collects the liquid in the ejection head through the cap, circulates the liquid to the tank along the liquid collection path, and adjusts the internal pressure of the tank to a desired value.

5. The image forming apparatus as defined in claim 4, wherein the liquid holding structure is formed from at least one of a porous member and a rib-form member.

6. The image forming apparatus as defined in claim 4, further comprising:

a drain which discharges the liquid to a bottom face of the cap and is provided on an upstream side of the liquid holding structure in a flow direction of the liquid that is collected in the cap, wherein the liquid holding structure also has a filter function.

7. The image forming apparatus as defined in claim 6, wherein the bottom face of the cap which receives the liquid collected in the cap is inclined so tat a part in which the drain is formed forms a lowest part of the cap.

8. The image forming apparatus as defined in claim 4, further comprising:

a drain which discharges the liquid to a bottom face of the cap and is provided on an upstream side of the liquid holding structure in a flow direction of the liquid that is collected in the cap, wherein the cap comprises a filter between the liquid holding structure and a reception side for the liquid That is collected in the cap.

9. The image forming apparatus as defined in claim 8, wherein the filter is disposed in a higher position than the bottom face of the cap in which the drain is formed.

10. The image forming apparatus as defined in claim 8, wherein the bottom face of the cap which receives the liquid collected in the cap is inclined so that a part in which the drain is formed forms a lowest part of the cap.

* * * * *